US005992663A

United States Patent [19]

Mitchell

[11] Patent Number: 5,992,663

[45] Date of Patent: Nov. 30, 1999

[54] SECURITY CONTAINERS

[75] Inventor: David Sayers Mitchell, South Glamorgan, United Kingdom

[73] Assignee: Scafftag Limited, South Glamorgan, United Kingdom

[21] Appl. No.: 09/171,006

[22] PCT Filed: Apr. 11, 1997

[86] PCT No.: PCT/GB97/01004

§ 371 Date: Dec. 1, 1998

§ 102(e) Date: Dec. 1, 1998

[87] PCT Pub. No.: WO97/38193

PCT Pub. Date: Oct. 16, 1997

[30] Foreign Application Priority Data

Apr. 11, 1996 [GB] United Kingdom ..... 9607553

[51] Int. Cl.[6] ..... B65D 8/18

[52] U.S. Cl. ..... 220/4.21

[58] Field of Search ..... 220/4.21, 4.22, 220/4.23, 4.24, 751, 780; 40/299.01, 665, 305

[56] References Cited

U.S. PATENT DOCUMENTS

| | | | |
|---|---|---|---|
| 262,946 | 8/1882 | Glover . | |
| 822,255 | 6/1906 | Ellis . | |
| 1,359,784 | 11/1920 | Behrman . | |
| 1,952,085 | 3/1934 | Mayer . | |
| 3,367,157 | 2/1968 | Woofter . | |
| 4,549,693 | 10/1985 | Barlics | 239/58 |
| 4,727,668 | 3/1988 | Anderson et al. | 40/625 |

*Primary Examiner*—Stephen Castellano
*Attorney, Agent, or Firm*—Young & Thompson

[57] ABSTRACT

A security container has two dished parts (1, 2) that can be closed together rim (6) to rim (11), irreversibly engaging and making inaccessible a snap fitting (7, 13) within the container. A strop (3) with loops (4) in its ends has those loops placed over part of the snap fitting (13) before closure, leaving its bight (5) outside. The strop (3) is thus made captive when the container is closed. The strop (5) passes through an aperture formed by cutouts (10, 12) in the rims (6, 11).

7 Claims, 3 Drawing Sheets

SECURITY CONTAINERS

This invention relates to security containers. It is particularly concerned with small containers housing an electronic device which should not be tampered with, and to which physical access is never required. For example, it could be a transponder which may be interrogated from time to time by a radio frequency identification device. There is no need for a lock and key closure: the container should be closable about the device with an irreversible action, requiring damage or even destruction to gain access again.

In addition, the container itself should have means for making it secure to a fixed object associated with or being the member to which the electronic device relates.

It is the aim of this invention to provide such a security container.

According to the present invention there is provided a security container characterised by two parts that snap together in an effectively inseparable manner to make a substantially closed chamber apart from an aperture through which a strop with a closed loop can extend, the container internally having a formation over which the loop can pass with the parts separated, but which is trapped when the parts are snap fitted together.

In the preferred form, the strop has two closed loops, one at each end, whereby both can be passed over the formation to leave the intermediate section as a bight that lies largely outside the container. The aperture is conveniently formed by a cutaway portion in at least one rim of one part, the opposed rim co-operating as the container is closed to complete the aperture. The aperture may be elongated to accept two passes of the strop, or there may be a separate aperture for each. The strop can thus be passed round an object and its two loops brought together and made captive inside the container whose two parts are then closed together.

Conveniently, the formation is part of the snap fitting. It may be an internally barbed socket on one part which receives and retains a toothed pillar on the other part. The barbs will be inaccessible to manipulation from outside the closed container.

In addition, the container may have externally on at least one part means for retaining a label which will give eye-readable information about the member to which the container is attached.

For a better understanding of the invention, one embodiment will now be described, by way of example, with reference to the accompanying drawings, in which.

Figure 1:
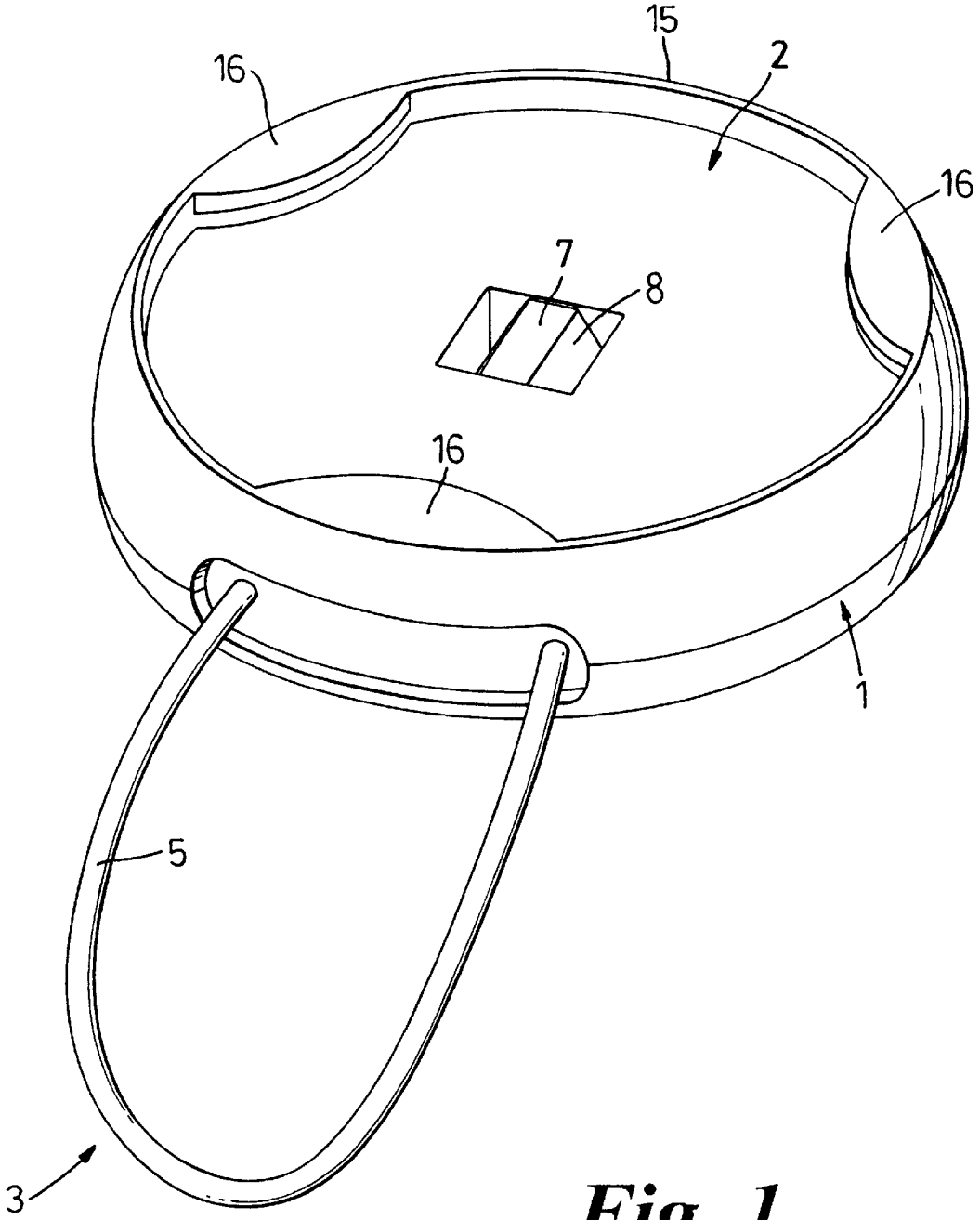
FIG. 1 is a perspective view of a security container.
Figure 2:
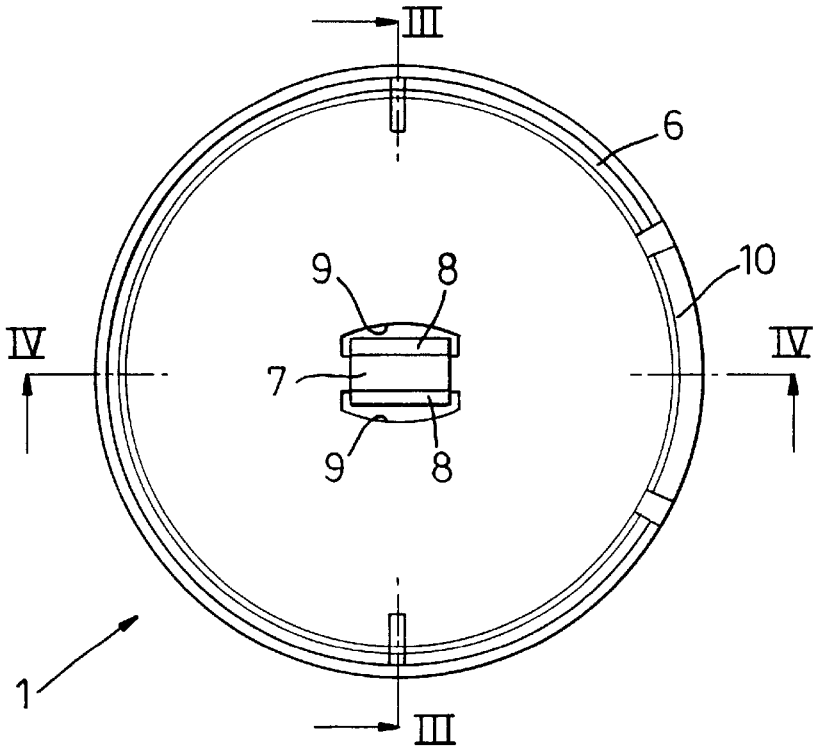
FIG. 2 is an interior plan view of one part of the container.
Figure 3:
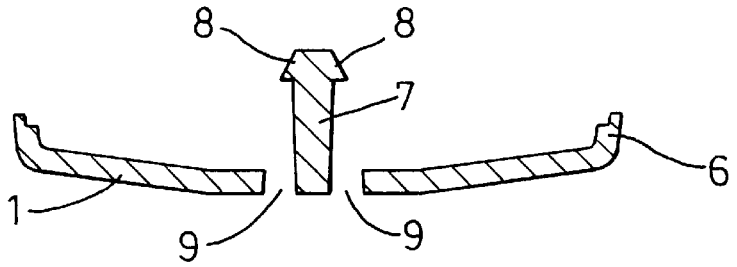
FIG. 3 is a section on the line III—III of FIG. 2.
Figure 4:
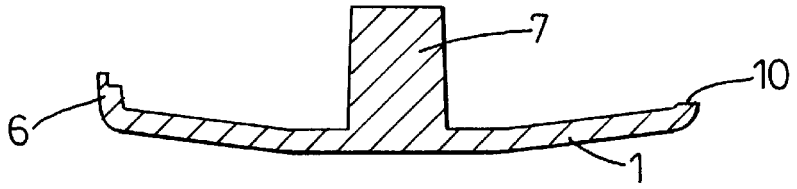
FIG. 4 is a section on the line IV—IV of FIG. 2.

The container has two complementary circular dish-like parts 1 and 2 with a strop 3, all in plastics material. The strop has loops 4 at each end with an intermediate portion 5 that forms a bight outside the closed container while the loops 4 are trapped inside, as described below.

The part 1 has a stepped rim 6 and a central, rectangular pillar 7 projecting from the centre of its interior surface well above the rim 6. At its upper end, the pillar has teeth 8, on each of the two larger sides, with sloping flanks tapering in towards the top and with undersides substantially at right angles to the pillar. At the base of the pillar there are apertures 9 at each of the larger sides, left by the teeth moulding process. Part of the rim 6 is cut away or reduced at 10.

The other part 2 has a stepped rim 11 complementary to the rim 6, and has a cutaway or reduced portion 12 which will register with the portion 10 when the parts are brought together. The bight 5 of the strop 3 passes through the resultant slot.

While this symmetrical arrangement is preferred, an adequate slot could be obtained by cutting away just one rim. Also, instead of having an elongate slot, two separate apertures, each to take one pass of the strop, could be provided in a similar manner.

The part 2 also has a socket 13 upstanding from the centre of its interior surface to project above the rim 11. Externally it is cylindrical, but internally it is square Externally it is cylindrical, but internally it is square with barbs 14 pointing back from two opposite sides towards the exterior but with their tips well within the socket. The dimensions are such that, when the two parts 1 and 2 are brought together with the pillar 7 entering the socket 13 and the teeth 8 snapping past the barbs 14, the rims 6 and 11 firmly engage and the top of the pillar 7 is left flush with the exterior of the part 2.

Figure 5:
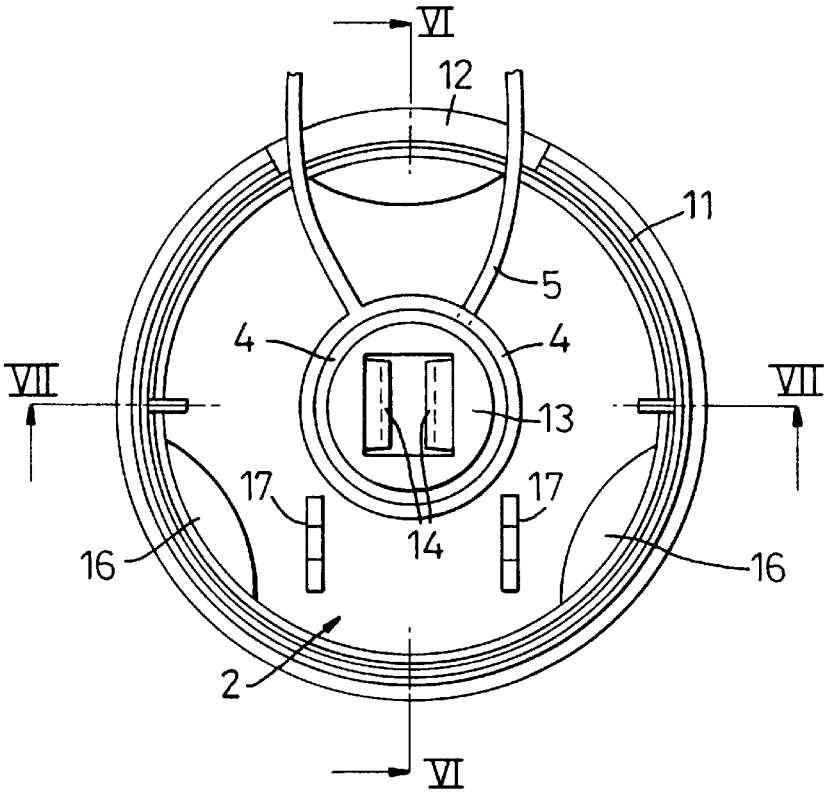
FIG. 5 is an interior plan view of another part of the container.
Figure 6:
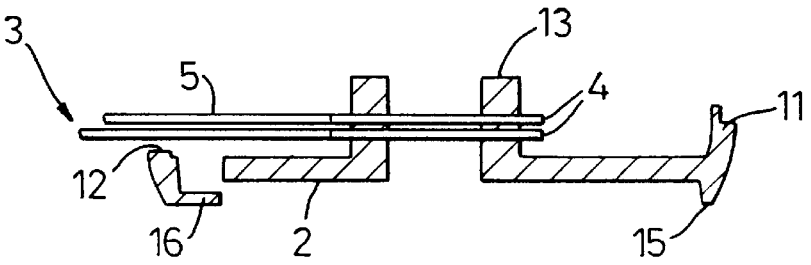
FIG. 6 is a section on the line VI—VI of FIG. 5.
Figure 7:
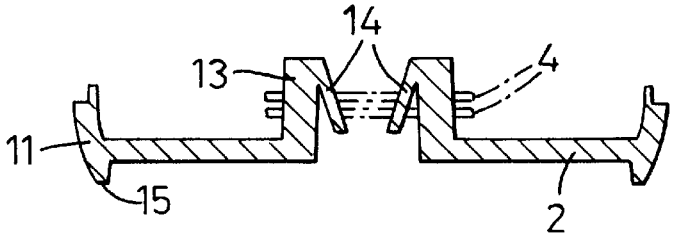
FIG. 7 is a section on the line VII—VII of FIG. 5.

The exterior of the part 2 is different from that of the part 1. It is made flat rather than with a shallow dome and is surrounded by a secondary rim 15 backing the rim 11. At three equidistant positions around this rim 15, lugs 16 project inwardly and provide means for holding a circular label (not shown) which can be worked into the shallow circular recess. The lugs 16 are visible in the interior view of FIG. 5 since matching apertures are left beneath them by the moulding process.

Within the part 2, to one side of the socket 13, there are two integrally moulded forks 17 for snap fitting and holding a cylindrical electronic component in the manner of a fuse in an electrical plug. This is just one way in which an item to be protected may be held within the container.

It will be understood that, once the component(s) is (or are) in place, the container is made fast to the associated object by passing the bight 5 of the strop 3 around it as described and then trapping the loops 4 by the socket/pillar assembly as the container is closed.

While the strop with both ends captive within the container is preferred, it may be appropriate just to have one end so trapped. For example, the strop may be taken round the associated object and one loop passed through the other loop. Then just the one loop would be placed over the socket 13 before the container is closed.

It will be understood that there could be more than just one pillar and socket holding the parts together, and if two were provided, each might receive one loop 4. Further security may also be obtained by having the rims 6, 11 snap together in a positive manner.

I claim:

1. A security container characterised by two parts (1, 2) that snap together in an effectively inseparable manner to make a substantially closed chamber apart from an aperture (10, 12) through which a strop (3) with a closed loop (4) can extend, the container internally having a formation (13) over which the loop (4) can pass with the parts (1, 2) separated, but which is trapped when the parts are snap fitted together.

2. A security container as claimed in claim 1, characterised in that the strop (3) has two closed loops (4), one at each end, whereby both can be passed over the formation (13) to leave the intermediate section as a bight (5) that lies largely outside the container.

3. A security container as claimed in claim 1, characterised in that the aperture is formed by a cutaway portion (10, 12) in at least one rim (6, 11) of one part, the opposed rim co-operating as the container is closed to complete the aperture.

4. A security container as claimed in claim 2, characterised in that the aperture (10, 12) is elongated to accept two passes of the strop (3).

5. A security container as claimed in claim 1, characterised in that the formation (13) is part of the snap fitting.

6. A security container as claimed in claim 5, characterised in that the snap fitting includes an internally barbed socket (13) on one part which receives and retains a toothed pillar (7).

7. A security container as claimed in claim 1, characterised in that the container has externally on at least one part (2) means (15, 16) for retaining a label which will give eye-readable information about the member to which the container is attached.

* * * * *